US007071446B1

(12) United States Patent
Bench

(10) Patent No.: US 7,071,446 B1
(45) Date of Patent: Jul. 4, 2006

(54) DE-ICING, SNOW MELTING AND WARMING SYSTEM

(76) Inventor: Steven D. Bench, 4403 S. 500 W., Murray, UT (US) 84123

( * ) Notice: Subject to any disclaimer, the term of this patent is extended or adjusted under 35 U.S.C. 154(b) by 0 days.

(21) Appl. No.: 11/193,829

(22) Filed: Aug. 1, 2005

(51) Int. Cl.
*H05B 1/00* (2006.01)

(52) U.S. Cl. ..... 219/213; 219/211; 219/535; 219/525; 219/528; 219/544; 219/546; 219/537; 338/266; 338/286; 338/287; 52/24; 52/11

(58) Field of Classification Search ..... 219/211–213, 219/535–537, 525–526, 528, 544, 546–48; 338/266–269, 286, 287; 52/24, 11
See application file for complete search history.

(56) References Cited

U.S. PATENT DOCUMENTS 4,401,880 A 8/1983 Eizenhoefer
4,439,666 A 3/1984 Graham
4,581,522 A 4/1986 Graham
4,889,975 A 12/1989 Farkas et al.
5,403,993 A 4/1995 Cordia et al.
5,814,792 A * 9/1998 Wildi ..... 219/544
6,225,600 B1 5/2001 Burris
6,489,594 B1 12/2002 Jones
6,708,452 B1 3/2004 Tenute

* cited by examiner

*Primary Examiner*—Shawntina Fuqua
(74) *Attorney, Agent, or Firm*—Gordon K. Anderson

(57) ABSTRACT

A de-icing, snow melting and warming system is taught which utilizes a heatsink (20) consisting of a number of board strips disposed in a planer array positioned within a building structure between its exterior and interior surface. The heatsink board strips have a gap (24) therebetween in which a heating cable (42) is positioned in a continuous serpentine manner and held in place with loop clamps (44). A gap filler (48) encases the heating cable including the enclosed gap forming a homogenous closure. A low voltage power transformer (54) is attached to electrical mains providing electrical voltage reduction to the heating cable of 30 volts or less, and controls and self diagnostics regulate the power and detect anomalies within the system.

18 Claims, 5 Drawing Sheets

DE-ICING, SNOW MELTING AND WARMING SYSTEM

TECHNICAL FIELD

The present invention relates to heating systems for melting snow in general. More specifically to a heating system that melts snow and ice and yet is visually imperceptible as it is installed between an outside and an inside surface of a building structure.

BACKGROUND ART

Previously, many types of heating systems have been developed in endeavoring to provide an effective means to melt snow from building structures and to prevent ice dams on roofs.

The prior art listed below did not disclose patents that possess any of the novelty of the instant invention; however the following U.S. patents are considered related:

| Patent Number | Inventor | Issue Date |
|---|---|---|
| 4,401,880 | Eizenhoefer | Aug. 30, 1983 |
| 4,439,666 | Graham | Mar. 27, 1984 |
| 4,581,522 | Graham | Apr. 8, 1986 |
| 4,889,975 | Farkas et al. | Dec. 26, 1989 |
| 5,403,993 | Cordia et al. | Apr. 4, 1995 |
| 6,225,600 B1 | Burris | May 1, 2001 |
| 6,489,594 B2 | Jones | Dec. 3, 2002 |
| 6,708,452 B1 | Tenute | Mar. 23, 2004 |

U.S. Pat. No. 4,401,880 issued to Eizenhoefer teaches a device to melt ice and snow on a roof structure and to provide channels for the drainage of water. The device is an elongated rigid structure having a hinged end extending over a gutter and is removably supported on the roof. The device is formed of a highly conductive material having heating cables in contact with the outer structure for heat transfer and a number of apertures are formed in the upper surface permitting application on a dry or a snow covered roof.

Graham in U.S. Pat. Nos. 4,439,666 and 4,581,522 both disclose an electrical heating system for use in heating surfaces. A heating element is constructed of a mesh to screen of small gauge wire such that the total surface area of the wires is equal to or greater that of the adjacent area to be heated. The longitudinal wires are electrically conductive and made of a nonferrous metal and the transverse wires are coated with an insulating material. The heating element is positioned parallel to and adjacent to the surface to be heated. The heating system includes electronic circuitry which eliminates transmission of power surges, voltage spikes and chatter when the heating system is connected to an alternating current power source. The heating system also includes protective circuits and devices for preventing injury or damage due to transformer overheating, under or over current conditions and optionally a device that senses and prevents formation of ice on surfaces.

Burris in U.S. Pat. No. 6,225,600 B1 teaches a snow melting device for gutters that includes a strip positioned within a closed lower end of a gutter. The snow melting strip serves to melt accumulated snow upon activation to allow proper drainage of water through the downspouts of the gutter.

U.S. Pat. No. 6,489,594 B2 issued to Jones is for a snow melting apparatus that prevents ice dams on an outside surface of a building roof. A heat conduction devices is utilized formed of a thermally conductive material with one side coated with a high emissivity which transfers heat to the outer edge of a roof. A heat source is attached to the body portion of the heat conductive device.

Tenute in U.S. Pat. No. 6,708,452 B1 discloses a heating arrangement for gutter protection where the gutter extends over at least a portion of a rain gutter. The heating arrangement includes an elongated protector cap extending along the gutter with a heating element within the cap. The cap is formed to be attached to the gutter protector either on the top or underneath and in either instance within a channel formed in the cap. Two or more heating elements are spaced from one another depending upon the heating requirements.

For background purposes and as indicative of the art to which the invention is related reference may be made to the remaining cited patents issued to Farkas et al. in U.S. Pat. No. 4,889,975 and Cordia et al. in U.S. Pat. No. 5,403,993

DISCLOSURE OF THE INVENTION

The invention installed within a roof prevents ice dams, icicles, removes snow build up and prevents snow slides from the roof. One of the important advantages of the invention is that the system uses a heatsink that is built into the structure during the building process between the exterior and interior surface completely isolating it from the prevailing environment.

The de-icing, snow melting and warming system overcomes many of the problems associated with the commonly used line voltage systems using heating tape or heating cables exclusively which are fragile and easily damaged. Probably the most universal problem is the weathering as many conventional technologies apply the tape or cables in an exposed area where the solar radiation, ozone and other environmental elements cause deterioration of the surface covering.

A primary object of the invention is the use of a low voltage heating cable that is completely enclosed within a heatsink and covered with a grout that fills a gap between an array of heatsink board strips of cementitious material making it impervious to external forces. The low voltage power has many advantages over line voltage as it is safer relative to human intervention and since the voltage is under 30 volts AC the governing safety code regulations are much less restrictive making the system easier to install.

An important object of the invention is its versatility as the system may be applied not only to building roofs but steps, decks and walkways or any other building structures that are subjected to ice and snow. Floors inside and out may also be provided with the heatsink kit for floor warming or at the least the heating cable suspended in a serpentine to manner within the floor structure to provide radiant heating. Since not all buildings have the same geometry and the areas which require heating vary greatly, the invention is ideal since during the heatsink installation it may easily be altered and custom fit to the exact configuration required.

Another object of the invention is that when installed the heatsink with this internal heating cable is completely invisible as it is completely enclosed within and forms an integral part of the building structure. The transformer and control box are located inside at a location which is convenient and normally in an area where other electrical equipment is found.

Still another object of the invention is in the self diagnostics capabilities of the system which automatically protects and shuts off the transformer from over temperature and the heater cable from over current or undercurrent and shorting or arcing while indicating the fault that has occurred by energizing an appropriate light emitting diode which will remain lit until the fault has been corrected.

Yet another object of the invention is that the system is cost effective as the components are all well known in the art and therefore the economies of number can be employed. The heatsink itself is furnished in kit form which is installed by the same workmen that are already on site and simply includes a simple task in the construction process.

A further object of the invention is that the system using the heating cable is powerful enough to release 11.52 watts of energy or 39.9 British thermal units (BTU) per linear foot at 30 volts AC. This heating source is sufficient to melt ice or snow quickly and completely under normal winter conditions in this country.

A final object of the invention is that the system is repairability as the controls are all accessible and easy to repair or replace and the heatsink itself requires no maintenance at all even to the extent that a factory warranty of 25 years may be easily achieved with little or no risk involved.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
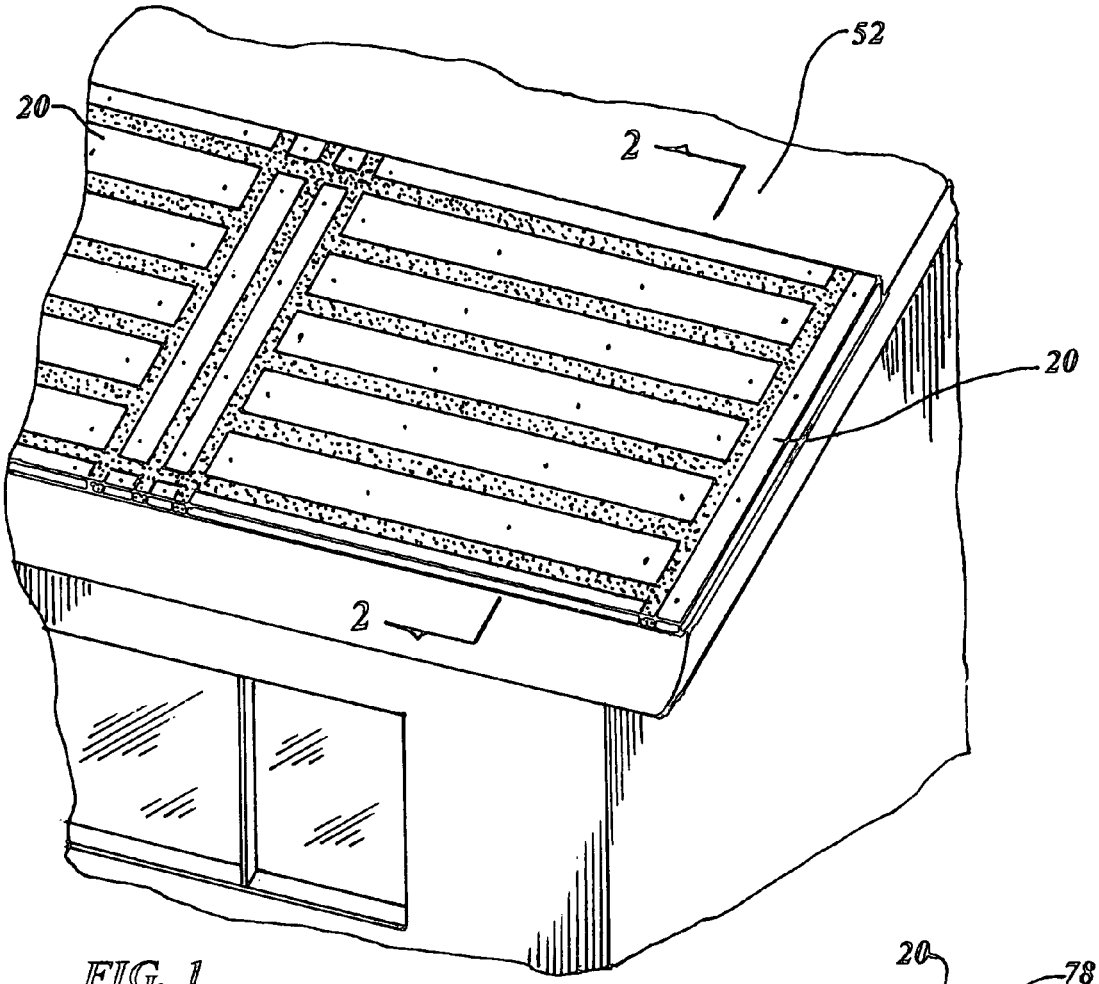
FIG. 1 is a partial isometric view of the heatsink in the preferred embodiment disposed on a sub-roof prior to the installation of the top roofing material.
Figure 2:
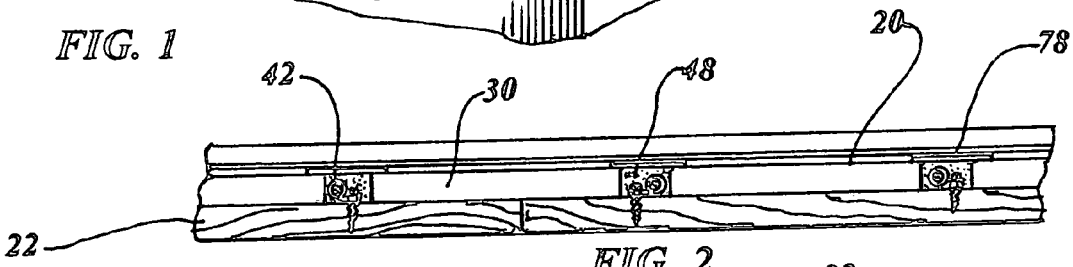
FIG. 2 is a cross sectional view taken along lines 2—2 of FIG. 1 except roofing is illustrated installed over the heatsink.

The best mode for carrying out the invention of the de-icing, snow melting and warming system 10 is presented in terms of a preferred embodiment with the system 10 used on one or more parts of a building such as its roof, steps, deck, floor or walkway. This preferred embodiment of the invention is shown in FIGS. 1 thorough 22 and is initially comprised of a heatsink 20 preferably made up from a heatsink kit 20'.

The heatsink kit 20' is illustrated in FIGS. 3–12 and consists of the heatsink 20 which is comprised of a planer array of board strips attached to building sub-roof 22 basically between a building exterior surface and a building interior surface. A gap 24 is provided between the strips as shown as it would be partially installed on a roof 26 in FIG. 3 and the strips and caps are shown separately in FIGS. 4–10. The kit 20' preferably includes a plurality of heatsink board strips consisting of one heatsink starting strip 28, five heatsink middle strips 30, one heatsink ending strip 32, one return cap 34, one origination cap 36, one large end cap 38 and one small end cap 40. The heatsink board strips making up the kit 20' are preferably made of a cementitious board such as Hardi Backer Board which is well known in the art and in common usage. The cementitious board is fire proof and has the required heat transfer characteristics however other material may be substituted with equal ease provided the desired distinguishing features are maintained.

Figure 3:
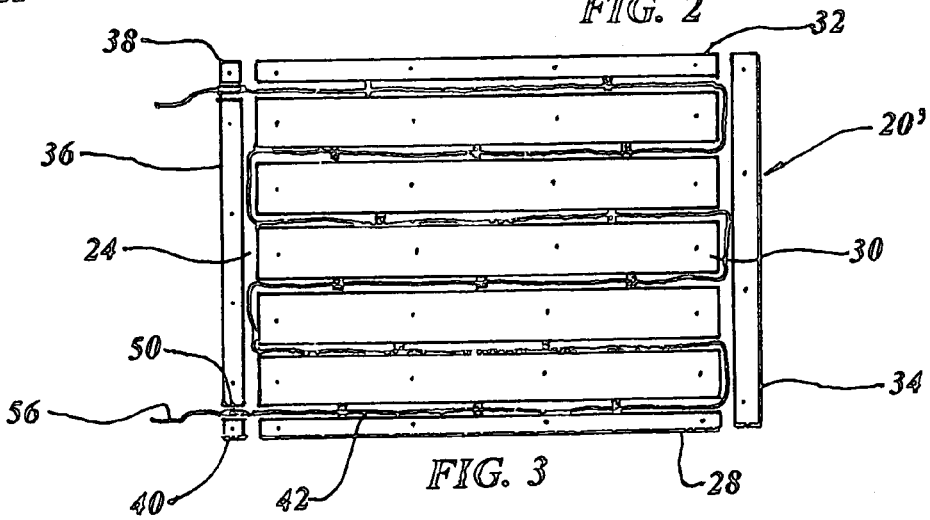
FIG. 3 is a top plan view of only the heatsink kit with the heating cable with clamps as it would be attached to a building sub-roof within the gap between the heatsink strips prior to the application of the gap filler.
Figure 4:
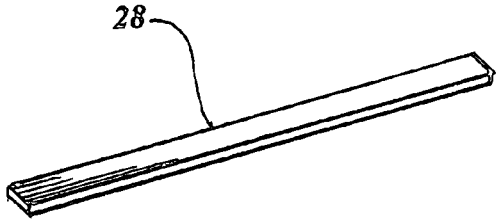
FIG. 4 is a partial isometric view the heatsink starting strip included in the heatsink kit.
Figure 5:
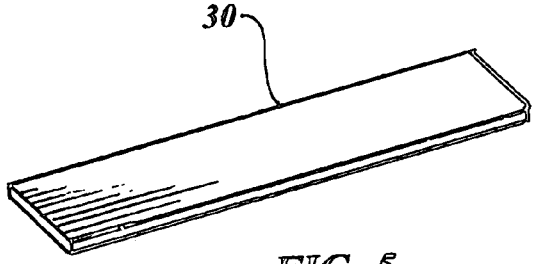
FIG. 5 is a partial isometric view of one of the five heatsink middle strips included in the heatsink kit.
Figure 6:
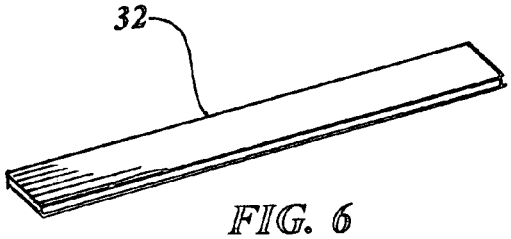
FIG. 6 is a partial isometric view the heatsink ending strip included in the heatsink kit.
Figure 7:
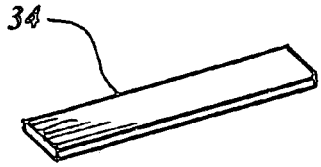
FIG. 7 is a partial isometric view the heatsink return cap included in the heatsink kit.
Figure 8:
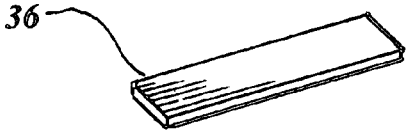
FIG. 8 is a partial isometric view the heatsink originating cap included in the heatsink kit.
Figure 9:
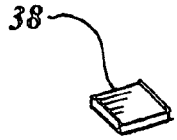
FIG. 9 is a partial isometric view the heatsink large end cap included in the heatsink kit.
Figure 10:
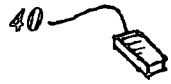
FIG. 10 is a partial isometric view the heatsink small end cap included in the heatsink kit.
Figure 11:
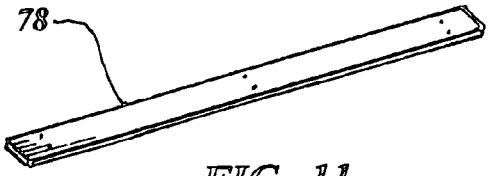
FIG. 11 is a partial isometric view one of the optional large stainless steel nail protectors.
Figure 12:
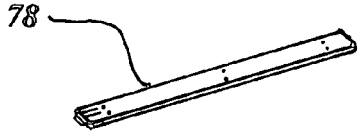
FIG. 12 is a partial isometric view one of the optional small stainless steel nail protectors.

FIGS. 412 illustrate the heatsink board strips of the kit 20' individually and FIG. 3 as it would be attached to a sub-roof 22. As noted in the drawings the heatsink board strips are spaced apart leaving a constant width gap 24 therebetween preferably having a width of substantially 1.0 inch (2.54 cm). The gap 24 must be spaced wide enough to accommodate other elements and features therefore the size has been found to be optimum at this distance, however variations are totally acceptable.

Figure 13:
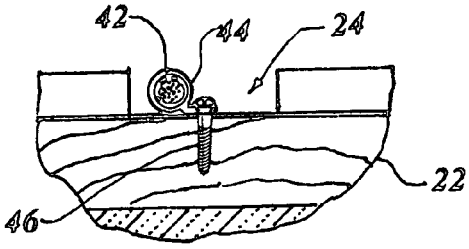
FIG. 13 is an arbitrary cross section of the kit in its partially installed condition with the heater cable attached to the building sub-roof, or decking, with the hook clamp attached with a wood screw.

A heating cable 42 is disposed in a continuous manner within the gap 24 between the heatsink board strips of the kit 20', as illustrated in FIGS. 3 and 13. A plastic loop clamp 44 is attached with fastening means, such as a wood screw 46, at convenient intervals to hold the cable 42 within the gap 24, also depicted in FIGS. 3 and 13. The heating cable 42 preferably consists of a AWG #10, copper, stranded, vinyl covered single conductor cable with a nylon jacket sized in length to produce a resistance output variable from 0 to 12 watts per linear foot (30.48 cm). The insulation on the wire is rated at an operating temperature of 90 degrees centigrade.

Figure 14:
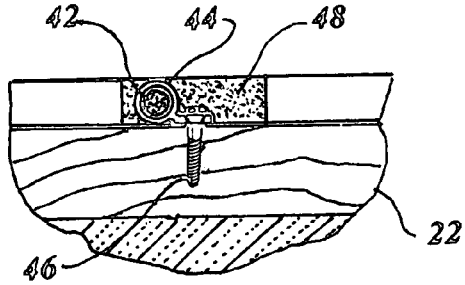
FIG. 14 is an arbitrary cross section of the kit in its fully installed condition with the heater cable attached with a hook clamp to the building sub-roof, or decking and the gap between the heatsink strips containing the hardened gap filler totally enclosing the cable.
Figure 15:
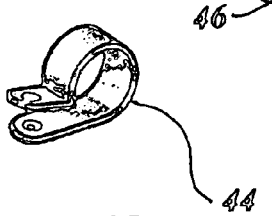
FIG. 15 is a partial isometric view of one of the loop straps for retaining the heating cable in place within the gap between the heatsink strips.
Figure 16:
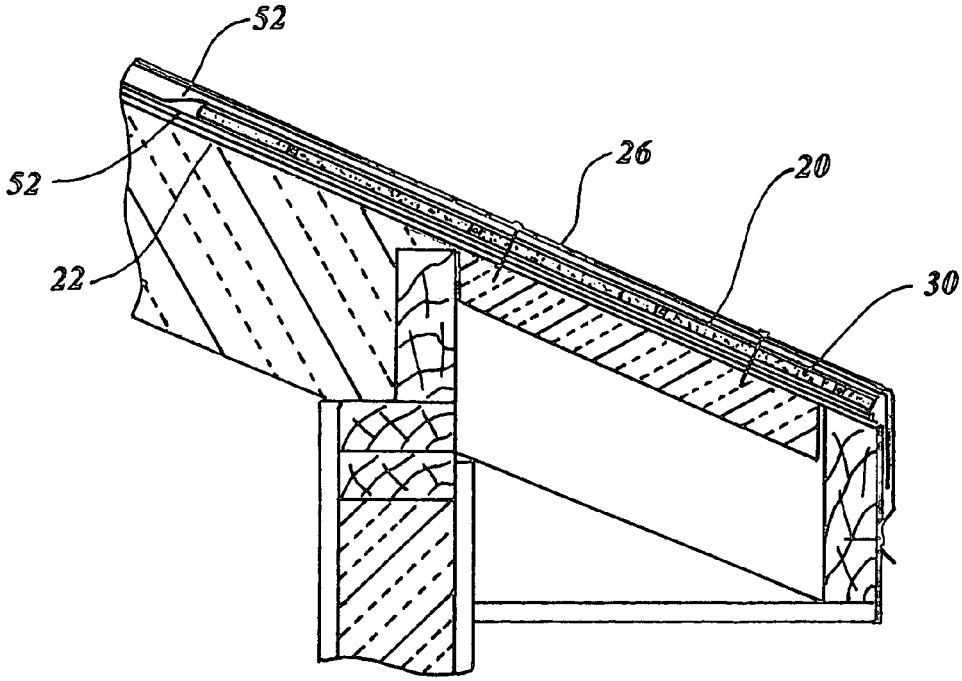
FIG. 16 is an arbitrary cross sectional view of the complete heatsink attached between the sub-roof and the top roofing of a typical eave with a waterproof membrane on both the top and bottom of the heatsink.
Figure 17:
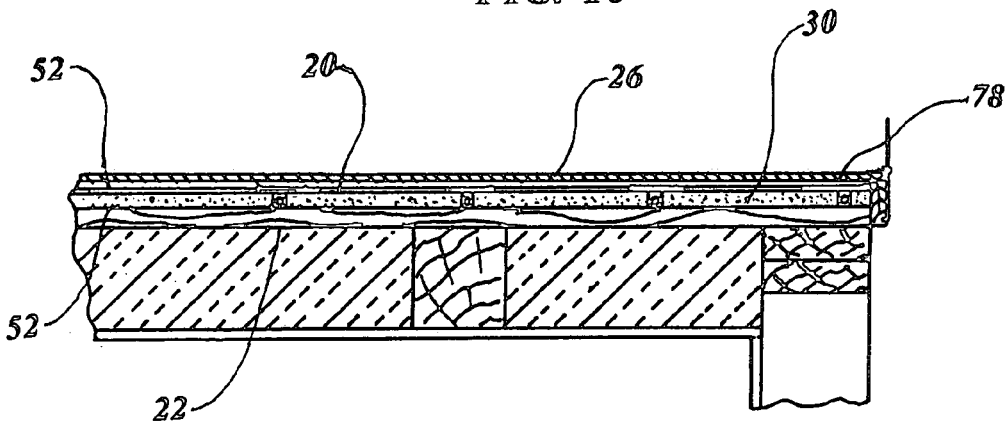
FIG. 17 is an arbitrary cross sectional view of the complete heatsink attached between the sub-roof and the top roofing of a typical flat roof with a waterproof membrane on both the top and bottom of the heatsink.
Figure 18:
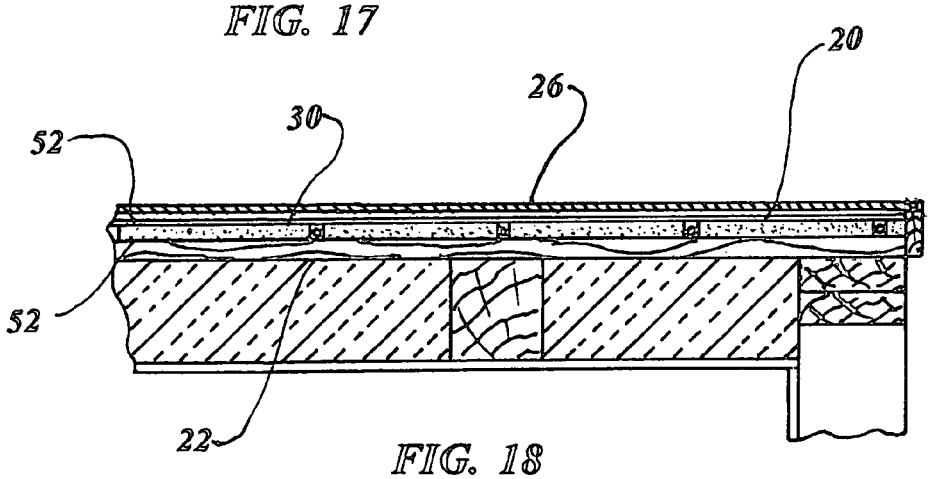
FIG. 18 is an arbitrary cross sectional view of the complete heatsink attached between the sub-roof and the top roofing of a typical deck with a waterproof membrane on both the top and bottom of the heatsink.
Figure 19:
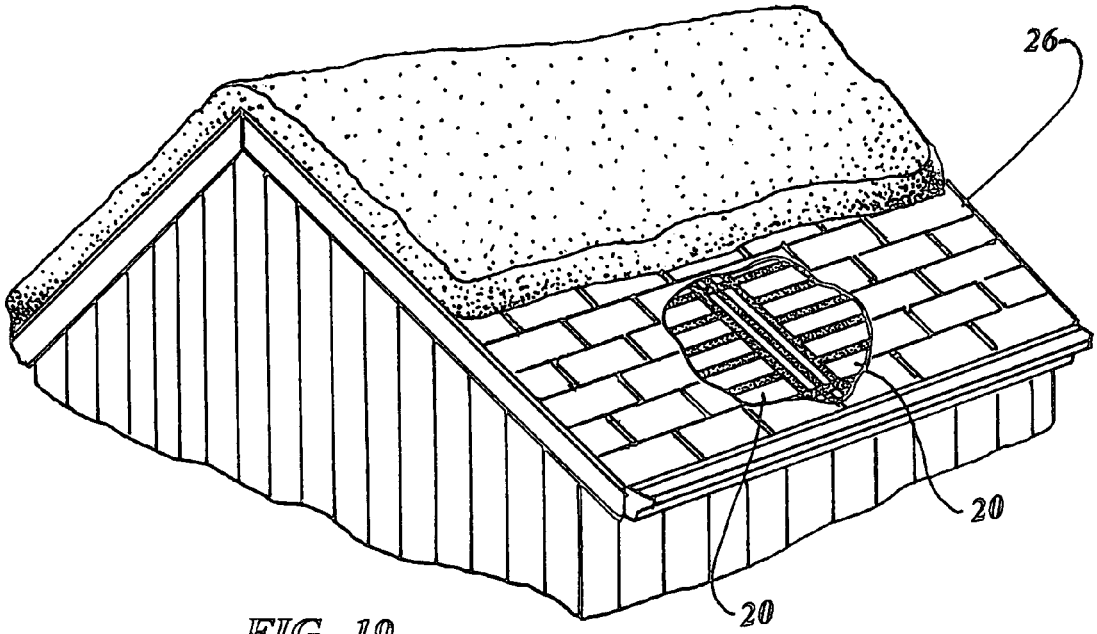
FIG. 19 is a partial isometric view of the invention in preferred embodiment installed on a roof with a pair of heatsinks shown in a cut away section of the top roofing material and snow melted away from the roof having the heatsinks installed.
Figure 20:
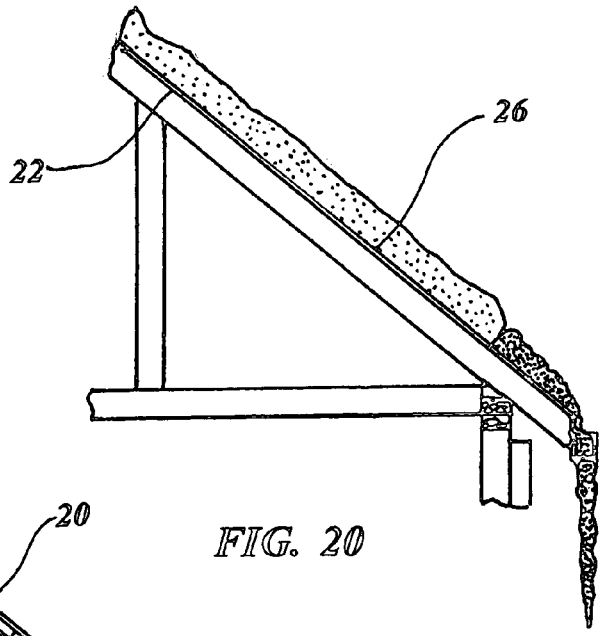
FIG. 20 is an arbitrary cross sectional view of a typical eave with an ice dam formed above the eave overhang, ice build up in the gutter and an icicle formed beneath the gutter.
Figure 21:
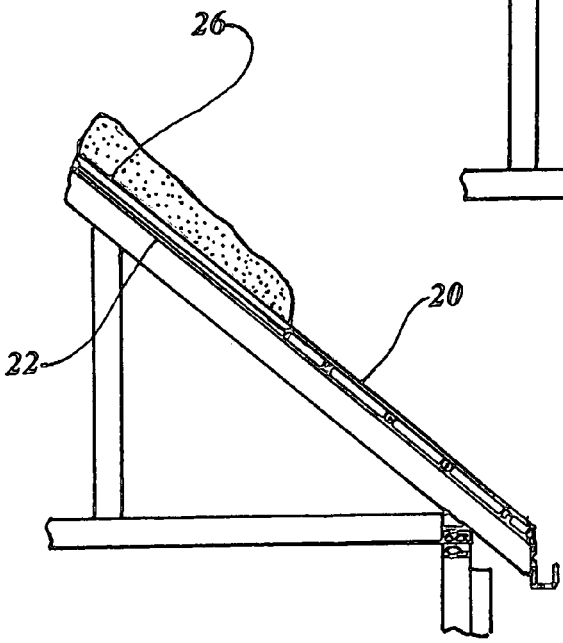
FIG. 21 is an arbitrary cross sectional view of a typical eave with the heatsink installed between the sub-roof and the top roofing gutter illustrating the snow melted and the roof clear of snow above the invention.
Figure 22:
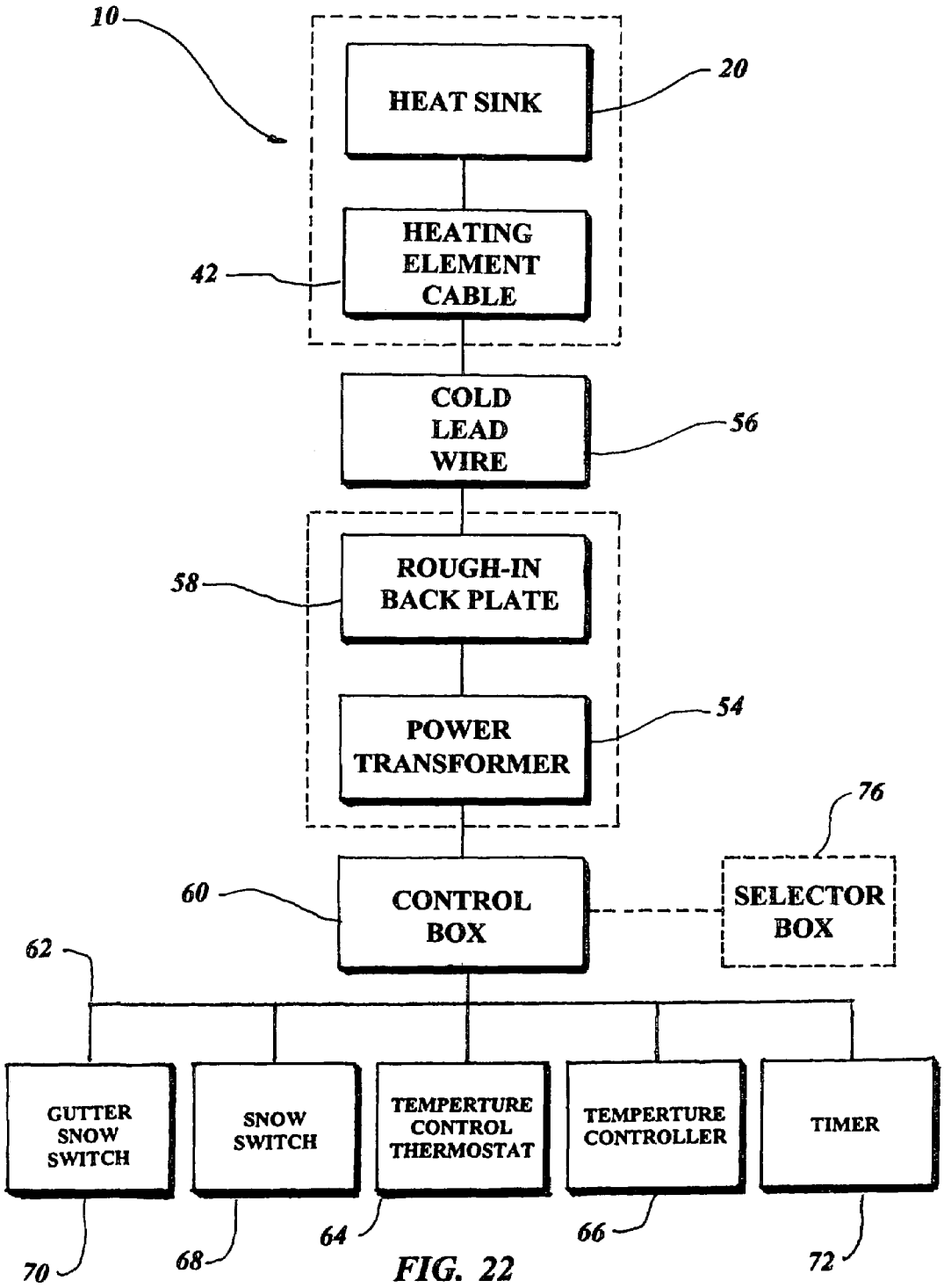
FIG. 22 is a block diagram of the heatsink, heating element cable, low voltage power transformer and controls for regulating power and the detection of abnormal conditions within the system

FIG. 14 illustrates sealing the cable 42 within the gap 24 using a gap filler 48 that encases the entire serpentine arrangement of the heating cable 42 and clamps 44 jointly forming a homogenous closure between each one of the heatsink board strips of the kit 20' as depicted in FIG. 1. The gap filler 48 consists of a mortar formulated of at least cement, lime, sand and water. The mortar may be the pre-mixed type or dry type with water added at the time of the installation. The pre-mixed mortar is sometimes known as the thin-set type used for tile and the like. The gap filler 48 in any of its variations completely fills the gap 24 leaving the heatsink 20 integrally attached together forming a single piece with only cold leads 50 of the cable 42 exposed on each end, as shown in FIG. 3.

In order to waterproof the heatsink 20 a moisture barrier film 52 is spread on top of the completed heatsink board strips of the kit 20' with the gap filler 48 installed to prevent moisture penetration. The moisture barrier film 52 is normally supplied by the installer when a roof or other exposed area is subject to rain or snowfall. Therefore some type of waterproofing membrane is necessarily included between the building exterior surface and interior surface which may easily cover the heatsink 20 at the time of installation. It is possible that a plastic film membrane or moisture barrier film 52 could also be used on both sides of the heatsink 20 as an option to insure the waterproofing capabilities, preferably using the so called BITUTHANE FILM.

A step down low voltage power transformer 54 is attached to electrical mains providing an electrical voltage reduction from the prevailing city power or mains to the heating cable 42 via a cold lead wire 56. The power transformer 54 supplies no more than 30 volts to the heating cable 42 which is sufficient to elevate the temperature of the heatsink 20 to a point assuring melting of any ice or snow resting thereupon. The low voltage power transformer 54 is preferably either the multi-tap or single primary type corresponding to the buildings mains power supply voltage with a multi-tap secondary which allows connection corresponding to a specific operating length of the heating cable 42. While not mandatory it is convenient that the low voltage power transformer 54 be mounted on a rough-in back plate 58 which also permits mounting of other controls and safety devices.

Controls and self diagnostics are included in the invention for regulating power and detection of anomalies of the system in the form of a control box unit 60 and activation device/s 62. The control box unit 60 consists preferably of a soft start device, a transformer over heat protector, a heater undercurrent and over current protection device and, a heater shorting and arcing protector with indicating lights in the form of light emitting diodes. The controls and self diagnostics automatically protect and deenergize the transformer or the heater and then indicate the fault by energizing light emitting diodes which remain lit until the fault has been corrected. It is also anticipated that other protective and detection devices may be added or some of the above mentioned devices omitted and still fall within the scope of the invention.

In order to automatically start and/or stop the de-icing, snow melting and warming system 10 at least one activation device 62 is required for energization such as a temperature sensing switch in the form of a temperature control thermostat 64, or an electronic temperature controller 66 with a remote sensor. Other viable controls include a moisture sensing device including a snow switch 68 and a gutter snow switch 70, and a mechanical or programmable timer 72.

In the event that two or more activation devices 62 are chosen an optional selector box 76 may be utilized that permits multiple inputs to be used simultaneously. It will be noted that the invention is not limited to the activation devices 62 described above as a myriad of controls, switches and safety devices are available that would also be well suited for the application.

The de-icing, snow melting and warming system 10 is installed on the building during construction as it is positioned between a building exterior and interior surface. The heatsink kit 20', consisting of strips 28, 30 and 32 along with caps 34, 36, 38 and 40, are positioned on the building sub-roof or decking in the desired location and spaced substantially 1.0 inch (2.54 cm) apart in a matrix and nailed into the decking or sub-roof The heating cable 42 is placed in the gap 24 between the strips and caps in a serpentine arrangement and attached with the loop clamps 44 and wood screws 46. The gap 24, including the attached heating cable, is packed level with gap filler 48 and allowed to set up after the biformed butt splices 50 have been attached to the exposed ends of the single conductor heating cable 42 and the cold lead wire 56. It will be noted that the biformed butt splice 50 must be imbedded in the heatsink 20 and surrounded by the gap filler 48. The biformed butt splice 50 is sized to accommodate the proper diameter of heating cable 42 on one end and a cold lead wire 56 on the other.

At this point in the installation a plurality of optional stainless steel nail protectors 78 may be attached over the gap 24 between the heatsink board strips for preventing accidental impingement of a nail into the heating cable causing shorts and arcing. The nail protectors 78 material is hard and thick enough to either stop a nail completely or at least limit its penetration such that the nail does not contact the heating cable 42.

At this point the installer then covers the heatsink 20 with an upper moisture barrier film 52 and installs the roof 26 or upper exterior surface of the building in the conventional manner. At an appropriate location, usually within the building, the rough-in backup plate 58 is installed along with the power transformer 54 and control box 60 and wired into the city power mains. The selected activation device or devices 62 are electrically connected to the control box 60 and wired remotely, if required, finishing the installation procedure.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A de-icing, snow melting and warming system which comprises, a heatsink having gaps therebetween, a heating cable positioned within said heatsink gaps covered with a gap filler with the heatsink, cable and gap filler mounted between a building exterior surface and a building interior surface, and a low voltage power transformer and controls for regulating power and detection of anomalies within the system.

2. The de-icing, snow melting and warming system as recited in claim 1 wherein said building exterior surface and building interior surface further comprises a building selected from the group consisting of a roof, steps, a deck, a floor and a building walkway.

3. A de-icing, snow melting and warming system which comprises, a plurality of heatsink board strips disposed in a planer array within a structure with said plurality of heatsink board strips having a gap therebetween, a heating cable disposed in a continuous manner within said gap between the plurality of heatsink board strips, a gap filler encasing the heating cable and gap jointly forming a homogenous closure, a low voltage power transformer attached to electrical mains providing electrical voltage reduction to said heating cable, and controls and self diagnostics for regulating power and detection of anomalies of the system.

4. The de-icing, snow melting and warming system as recited in claim 3 wherein said structure further comprises part of a building selected from the group consisting of a roof, a plurality of steps, a deck, a floor and a building walkway, and said heatsink board strips disposed in a planer array within a structure is further defined as the heatsink board strips being positioned between a building exterior surface and a building interior surface.

5. The de-icing, snow melting and warming system as recited in claim 3 wherein said plurality of heatsink board strips further comprise a cementitious board.

6. The de-icing, snow melting and warming system as recited in claim 3 wherein said heatsink board strips having a gap therebetween further comprises a width of substantially 1.0 inch wide (2.54 cm).

7. The de-icing, snow melting and warming system as recited in claim 3 wherein said heating cable further comprises a copper, stranded, vinyl covered single conductor cable with a nylon jacket.

8. The de-icing, snow melting and warming system as recited in claim 3 wherein said heating cable is sized to produce a resistance output variable from 0 to 12 watts per linear foot (30.48 cm).

9. The de-icing, snow melting and warming system as recited in claim 3 wherein said heating cable operating temperature does not exceed 90 degrees centigrade.

10. The de-icing, snow melting and warming system as recited in claim 3 wherein said gap filler further comprises a mortar consisting of at least cement, lime, sand and water.

11. The de-icing, snow melting and warming system as recited in claim 3 wherein said low voltage power transformer supplies a voltage no more than 30 volts to said cable from a primary mains supply.

12. The de-icing, snow melting and warming system as recited in claim 3 wherein said low voltage power transformer further comprises a multi-tap primary for corresponding with a mains power supply and a multi-tap secondary for corresponding to a specific operating length of the heating cable.

13. The de-icing, snow melting and warming system as recited in claim 3 wherein said low voltage power transformer further comprises a single primary corresponding to a mains power supply and a multi-tap secondary for corresponding to a specific operating length of the heating cable.

14. The de-icing, snow melting and warming system as recited in claim 3 wherein said controls and self diagnostics further comprise a control box unit and an activation device.

15. The de-icing, snow melting and warming system as recited in claim 14 wherein said control box unit further comprises at least a soft start device, a transformer over heat protector, a heater undercurrent and over current protection device, a heater shorting and arcing protector wherein said control box having a plurality of indicating lights defined as light emitting diodes which remain lit until a fault has been corrected.

16. The de-icing, snow melting and warming system as recited in claim 14 wherein said activation device further comprises at least one type of control selected from the group consisting of a temperature switch, a moisture sensing device, a mechanical timer, a programmable timer, an electronic temperature control, a remote temperature controller and a gutter snow switch.

17. The de-icing, snow melting and warming system as recited in claim 3 further comprising a plurality of stainless steel nail protectors attached over the gap between the heatsink board strips for preventing accidental impingement of a nail into the heating cable causing shorts and arcing.

18. The de-icing, snow melting and warming system as recited in claim 3 further comprising a moisture barrier film on top of said heatsink board strips and gap filler to prevent moisture penetration.

* * * * *